US005115516A

United States Patent [19]

Golde

[11] Patent Number: 5,115,516

[45] Date of Patent: May 26, 1992

[54] GARMENT WITH NECK COVERING

[75] Inventor: Paul J. Golde, Mission Viejo, Calif.

[73] Assignee: Intersport Fashions West, Inc., Orange, Calif.

[21] Appl. No.: 714,700

[22] Filed: Jun. 13, 1991

[51] Int. Cl.[5] ..... A41D 1/02

[52] U.S. Cl. ..... 2/108; 2/84; 2/91; 2/98; 2/102; 2/85

[58] Field of Search ..... 2/108, 102, 84, 85, 2/91, 98, 94

[56] References Cited

U.S. PATENT DOCUMENTS

| | | | |
|---|---|---|---|
| D. 181,831 | 1/1958 | Bacon . | |
| 1,850,496 | 3/1932 | Chisholm . | |
| 1,980,394 | 11/1934 | Falcon | 2/98 |
| 2,482,295 | 9/1949 | Schlafman | 2/92 |
| 3,276,037 | 10/1966 | Englehaupt | 2/146 |
| 3,466,663 | 9/1969 | Mehl | 2/65 |
| 3,479,667 | 11/1969 | Mehl | 2/65 |
| 4,470,155 | 9/1984 | Maeshima | 2/108 |
| 4,602,385 | 7/1986 | Warren | 2/2 |
| 4,718,123 | 1/1988 | Petropoulos | 2/91 |
| 4,771,479 | 9/1988 | Silver | 2/85 |
| 4,780,912 | 11/1988 | Harmsen | 2/91 |

FOREIGN PATENT DOCUMENTS

| | | | |
|---|---|---|---|
| 2586535 | 3/1987 | France | 2/108 |

*Primary Examiner*—Werner H. Schroeder
*Assistant Examiner*—Gloria Hale
*Attorney, Agent, or Firm*—Richard F. Carr; Richard L. Gausewitz; Allan Rothenberg

[57] ABSTRACT

A neck covering is provided for a jacket or other garment including a member attached at its central portion near the inside of the collar of the garment, with side portions projecting outwardly in either direction which can be wrapped around the neck of the wearer. Fasteners on the ends of the side portions secure the neck covering in place. The central part of the covering is constructed to attach to the lining of the jacket, which may be provided with a slot adjacent the attachment of the neck covering to permit the neck covering to be pushed through the slot and stowed in back of the lining when not in use.

12 Claims, 2 Drawing Sheets

GARMENT WITH NECK COVERING

BACKGROUND OF THE INVENTION

Jackets for motorcycle riders generally are made of leather and can effectively protect the wearer from cold weather as well as from certain injuries in the event of accident. However, it is not practical to provide other than a short collar on such jackets so that the neck region of the wearer of the jacket is exposed. In cool weather, the continual flow of air across the neck at a relatively high velocity can lead to considerable discomfort for the wearer of the jacket. On the other hand, in warm weather it is preferred to have the neck area exposed and a covering around the neck would be undesirable because it would become uncomfortably hot. In the past there has been no suitable means for alleviating this condition so that motorcycle riders have been subjected to discomfort from the cold air during cool weather. Similar problems exist for garments worn in other activities where the wearer may be subjected to air flowing at a relatively high speed.

SUMMARY OF THE INVENTION

The present invention provides a neck covering arrangement which effectively protects the wearer of the garment from the flow of air around the neck region, yet which can be removed and stowed out of the way when it is not needed. In the stowed position, the neck covering nevertheless is available for use instantly.

These results are achieved by a cloth element of generally T-shaped configuration which may be attached to the upper portion of the lining of the jacket near the collar. The side parts of the member are elongated and adapted to be wrapped around the neck and secured by an adjustable fastening means. The covering has a soft layer on the inside and an outside layer that deflects the wind so that when in place the neck region is kept warm and comfortable.

When it is not needed, the neck covering device is pushed down through an opening in the lining spaced beneath the attachment of the neck covering to the lining. Most of the neck cover then is behind the lining where it is out of sight and will not get in the way. Nevertheless, the neck cover is instantly available simply by pulling it out through the slot from behind the lining so that it may be put into use by wrapping it around the neck of the wearer of the jacket.

The neck protector of this invention is usable not only for motorcycle jackets, but also for garments worn for skiing, sailing or in other endeavors where there is a relatively high velocity of air encountered.

DETAILED DESCRIPTION OF THE INVENTION

Figure 1:
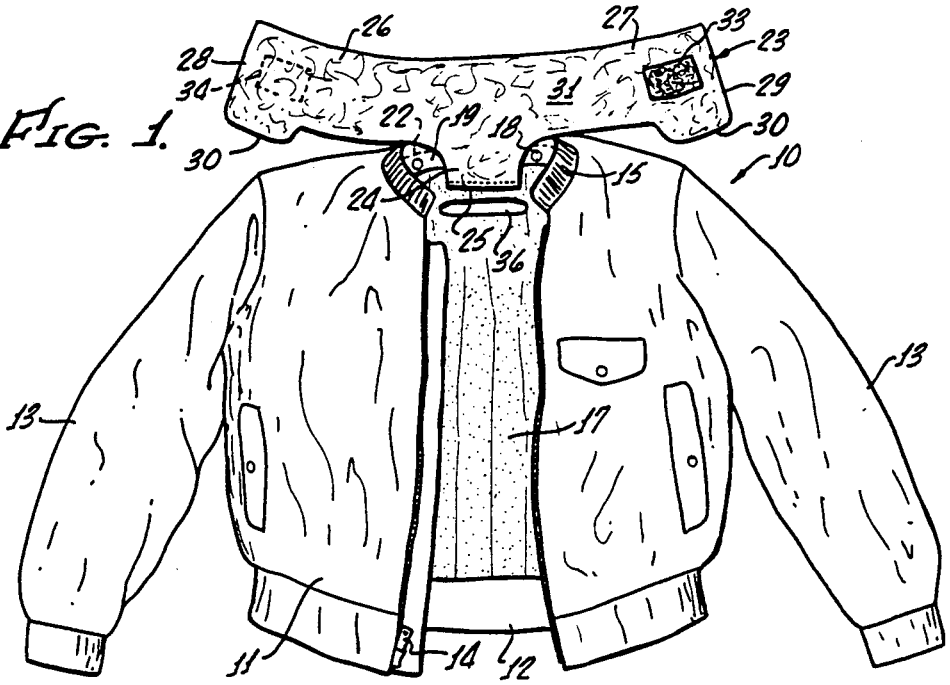
FIG. 1 is an elevational view of a garment that includes the neck covering of this invention.
Figure 3:
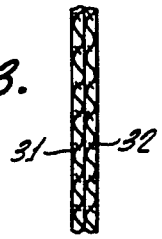
FIG. 3 is an enlarged fragmentary sectional view illustrating the laminated construction of the neck covering.
Figure 2:
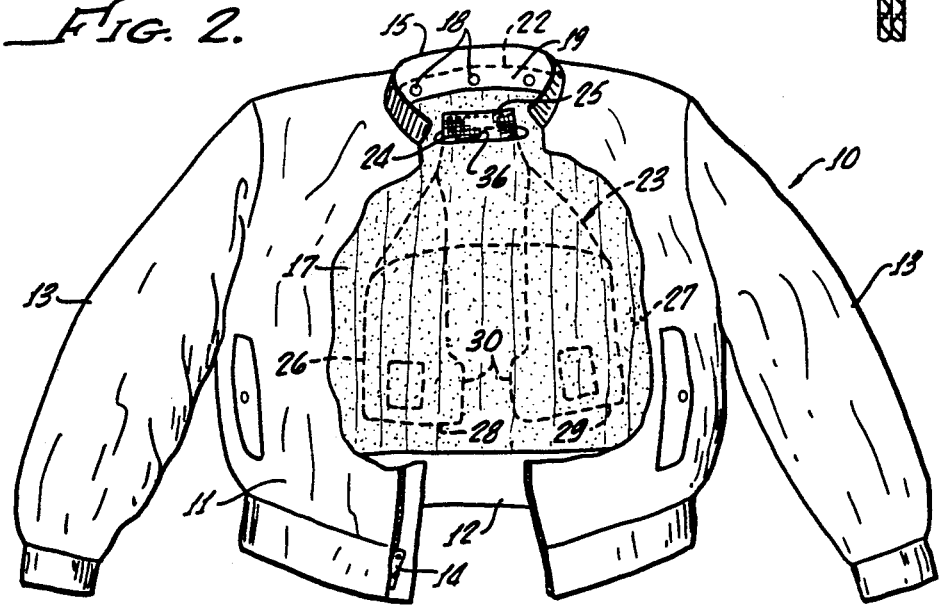
FIG. 2 is a view similar to FIG. 1, but with the neck covering in the stowed position.
Figure 4:
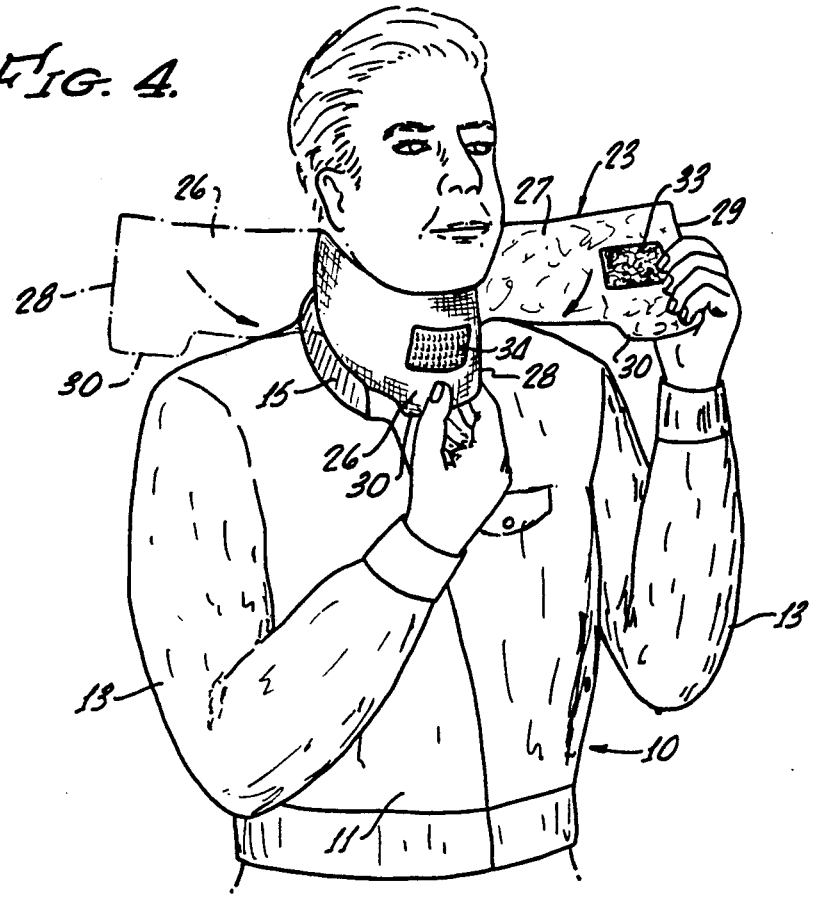
FIG. 4 is a perspective view illustrating the neck covering as it is being wrapped around the neck of the wearer of a garment.
Figure 5:
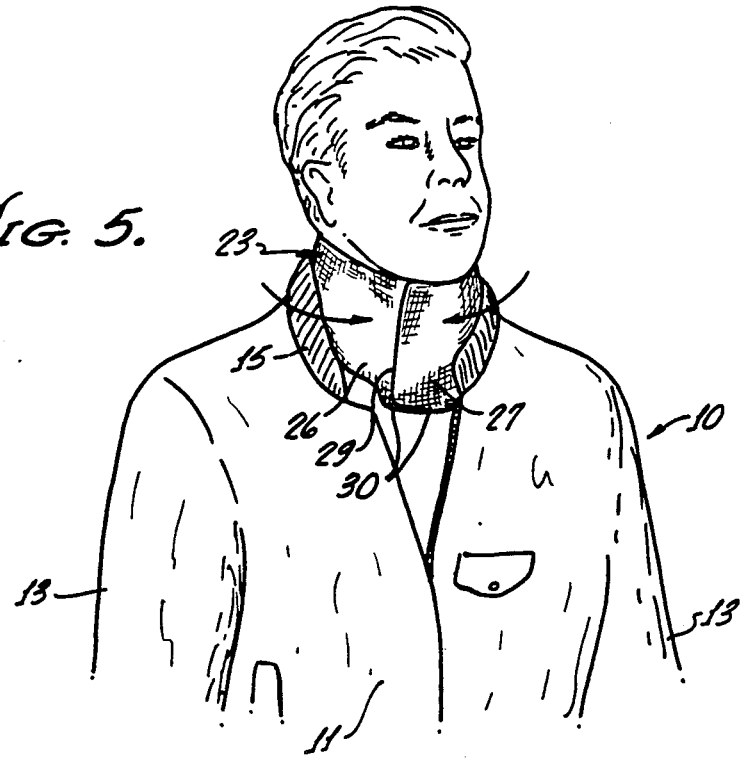
FIG. 5 is a view similar to FIG. 4 but with the neck covering fully in position around the neck.

The neck covering arrangement of this invention is adapted for use with a conventional garment, such as a leather motorcycle jacket 10, which has a front panel 11 and a back panel 12 with sleeves 13 projecting from the opposite sides of the front and back panels. The front panel is split and can be closed by a zipper 14. At the upper portion of the jacket is a short collar 15.

Within the jacket 10 is a lining 17 to make the jacket warmer. In the example illustrated, the lining 17 is removable, although the arrangement of this invention is usable also with linings permanently attached within a garment. The lining 17 overlies the front and back panels 12 and 13 and is held in the jacket by snap fasteners 18, with the edge of the lining positioned beneath a narrow flap 19 of the jacket. A collar portion 22 is at the central upper part of the lining 17 next to the collar 15 of the jacket.

A neck covering 23 is attached to the lining 17. The neck covering is a generally T-shaped cloth member having a central portion 24 which forms the base of the T and has a lower straight edge 25 stitched to the collar portion 22 of the lining 17. Two elongated generally rectangular side portions 26 and 27 extend outwardly from the central portion 24. The side portions curve outwardly slightly away from the collar 15 so that as viewed in elevation and as seen in FIG. 1 their outer end edges 28 and 29 are elevated. However, the neck covering is widened along its lower edge 30 adjacent the outer end edges 29 and 30.

The neck covering 23 consists of two layers, an inside layer 31 of fleece or other soft material which engages the neck of the wearer as the covering is used, and an outer layer 32 of woven nylon or other material that is generally impermeable to the passage of air. When the neck covering 23 extends upwardly away from the collar 22, as shown in FIG. 1, the soft layer 31 faces away from the back panel 12 of the jacket, i.e., toward the neck of a person wearing the jacket. Fasteners are provided on the outer ends of the side portions 26 and 27, preferably being a hook and pile fastener such as that marketed under the trademark VELCRO. As illustrated, the pile section 33 of the fastener is stitched to the inner layer 31 at the outside end portion of the side part 27. The mating hook portion 34 of the fastener is stitched to the outer layer 32 adjacent the outer end of the side portion 26.

When the neck covering is to be used, the central portion 24 is lifted upwardly to extend along the back of the neck of the wearer and the side portions 26 and 27 are wrapped around the neck. The device is secured in place by the fastener 33, which allows for attachments at different locations lengthwise of the side portions 26 and 27 so that the device will accommodate persons with different sizes of necks. The neck covering can fit snugly and will block the wind so that the neck region is much warmer than otherwise is the case. The widening of the end portions along the lower edge 30 assures that the base of the neck is protected at the collar opening when the jacket is closed by the zipper 14. As a result, the covering is especially effective for covering the neck of a motorcycle rider which otherwise may be chilled by air flowing past at a relatively high velocity. Nevertheless, the inner fleece layer 31 is comfortable next to the skin of the neck.

In warm weather, the neck covering 23 may be stowed behind the lining 17 out of sight and out of the way. To this end, a transverse slot 36 is provided through the back panel 18 of the lining 17, spaced a short distance below and parallel to the bottom edge 25 of the central portion 24 of the neck covering. The edge 25 of the neck cover 23, therefore, is between the slot 36 and the collar 15 of the jacket. The slot 36 is made slightly longer than the width of the central portion 24. To stow the neckpiece 23 the side portions 26 and 27 are folded inwardly and the central part is folded downwardly away from the collar 22 about the lower edge 25 where it is attached to the lining 17. The side portions 26 and 27 are pushed through the slot 36 so that these parts and part of the central portion 24 become positioned in back of the lining between the lining and the back panel 12 of the jacket 10. As a result, nearly all of the neck covering cannot be seen nor does it move around in the wind or otherwise get in the way. Only a short length of the central portion 24 is exposed when the neck covering 24 is in the stowed position. It is not necessary to remove or disturb the lining to stow the neck covering.

The neck covering is retrievable for use simply by pulling outwardly on the exposed part of the central portion 24, causing the entire neck covering to emerge from in back of the lining 17 through the slot 36. Thus, stowage and retrieval of the lining 17 can be accomplished in only a few moments of time.

The foregoing detailed description is to be clearly understood as given by way of illustration and example only, the spirit and scope of this invention being limited solely by the appended claims.

What is claimed is:

1. In combination with a garment having a back panel and a lining which includes a first portion having an edge and overlying said back panel and a collar portion at said edge of said first portion, a neck covering comprising a unitary sheet of flexible material having a central portion and two side portions projecting outwardly from the central portion on either side thereof, means for attaching one edge of said central portion to said lining adjacent said collar portion thereof so that said side portions of said neck covering are free and unconstrained and can be extended beyond said collar portion and wrapped around the neck of a wearer, and fastener means adjacent the ends of said side portions for securing said ends together and holding said neck covering around the neck of the wearer, said first portion of said lining having an opening adjacent said edge of said central portion, a major portion of said sheet of flexible material being insertable through said opening to allow said neck covering to be disposed behind said first portion of said lining when not wrapped around the neck of the wearer of said garment.

2. A neck covering as recited in claim 1 wherein said one edge of said central portion is spaced from said opening.

3. A neck covering as recited in claim 1 wherein said opening is elongated laterally of said lining.

4. A neck covering as recited in claim 1 wherein said one edge of said central portion is so attached to said lining at a location such that said collar portion is on one side of said one edge and said opening is on the opposite side of said one edge.

5. A neck covering as recited in claim 1 wherein said one edge of said central portion is positioned relative to said opening such that when a major portion of said sheet of flexible material is so inserted through said opening a part of said central portion adjacent said one edge is exposed to allow the same to be grasped for pulling said major portion back through said opening so that said side portions can be so wrapped around the neck of a wearer.

6. A neck covering as recited in claim 1 wherein said sheet of flexible material is generally T-shaped, said central portion thereof forming the base of the T, whereby for inserting a major portion of said sheet of flexible material through said opening, said central portion can be folded away from said collar portion of said lining.

7. A neck covering as recited in claim 6 wherein said T-shaped sheet of flexible material has a bottom edge, said one edge is substantially straight and transverse to said back panel, and said one edge is the bottom edge of said generally T-shaped sheet of flexible material.

8. A neck covering as recited in claim 1 wherein said flexible sheet material includes a plurality of layers one of which is of soft material relative to the material of another of said layers.

9. A neck covering as recited in claim 8 wherein when said side portions so extend outwardly beyond said collar portion said relatively soft layer faces in the same general direction as said back panel.

10. A neck covering as recited in claim 9 wherein another of said layers is of substantially air-impermeable material.

11. A jacket with provisions for covering the neck of a wearer comprising flexible sheet material arranged to provide front and back panels, sleeves projecting from the sides of said front and back panels, and a collar portion, said front panel being vertically split, closure means for said front panel, a lining in said sheet material and attached thereto, said lining including a back panel overlying said back panel of said flexible sheet material, and a collar portion configured to fit around the base of the neck of the wearer, and a neck cover selectively positionable around the neck of the wearer, said neck cover being of laminated flexible sheet material which includes a layer of air-impermeable material and a layer of relatively soft material, said neck cover including a central portion and two elongated side portions projecting laterally in opposite directions from said central portion, said central portion having an edge secured to said collar portion of said lining while said side portions are free and unconstrained, said sheet material of said neck cover being positionable so that it projects outwardly away from said collar portion of said lining in which position said layer of relatively soft material faces away from said back panel of said lining, and fastener means on the outer ends of said side portions whereby said side portions can be wrapped around the neck of the wearer of said jacket with said relatively soft layer on the inside and can be secured in that portion.

12. A neck covering as recited in claim 11 wherein said side portions diverge away from said collar portion of said lining toward their outer edges.

* * * * *